US010060213B2

(12) United States Patent
Maenza et al.

(10) Patent No.: US 10,060,213 B2
(45) Date of Patent: Aug. 28, 2018

(54) RESIDUAL PRESSURE DIFFERENTIAL REMOVAL MECHANISM FOR A SETTING DEVICE FOR A SUBTERRANEAN TOOL

(71) Applicant: BAKER HUGHES INCORPORATED, Houston, TX (US)

(72) Inventors: Frank J. Maenza, Houston, TX (US); Nicholas S. Conner, Cypress, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 271 days.

(21) Appl. No.: 14/883,159

(22) Filed: Oct. 14, 2015

(65) Prior Publication Data

US 2017/0107775 A1 Apr. 20, 2017

(51) Int. Cl.

| | |
|---|---|
| ***E21B 23/06*** | (2006.01) |
| ***E21B 23/04*** | (2006.01) |
| ***E21B 33/12*** | (2006.01) |
| ***E21B 34/06*** | (2006.01) |
| *E21B 34/00* | (2006.01) |

(52) U.S. Cl.

CPC ..... *E21B 23/04* (2013.01); *E21B 23/06* (2013.01); *E21B 33/12* (2013.01); *E21B 34/063* (2013.01); *E21B 2034/007* (2013.01)

(58) Field of Classification Search

None

See application file for complete search history.

(56) References Cited

U.S. PATENT DOCUMENTS

| | | | | |
|---|---|---|---|---|
| 4,487,258 | A | 12/1984 | Jackson et al. | |
| 8,453,729 | B2 * | 6/2013 | Harris | E21B 23/01 166/212 |
| 2007/0144731 | A1 | 6/2007 | Murray et al. | |
| 2007/0246227 | A1 | 10/2007 | Ezell et al. | |
| 2010/0252277 | A1 | 10/2010 | Gette | |
| 2012/0125629 | A1 | 5/2012 | Churchill | |
| 2015/0315871 | A1 * | 11/2015 | Fripp | E21B 23/06 166/374 |
| 2015/0315873 | A1 * | 11/2015 | Mailand | E21B 34/125 166/307 |
| 2015/0345252 | A1 * | 12/2015 | McNabb | E21B 34/12 166/318 |

* cited by examiner

*Primary Examiner* — Matthew R Buck
*Assistant Examiner* — Douglas S Wood
(74) *Attorney, Agent, or Firm* — Steve Rosenblatt

(57) ABSTRACT

A pressure actuated module associated with a subterranean tool is set with pressure in the well annulus supplemented by added pressure. The addition of pressure to the hydrostatic opens access to a setting piston that is referenced to a low pressure chamber. The piston strokes to a travel stop reducing the volume of the atmospheric chamber while setting the tool. After the tool is set the annulus is communicated to the low pressure reference chamber for the actuating piston to remove a residual net force on the setting piston after the set. One way to do this is to sequentially break multiple rupture discs at different pressures. Another is to have a degradable member in the atmospheric chamber. A piston is fixed in place during setting, and shifts with the application of additional pressure allowing pressure to pass through a port between the annulus and the atmospheric chamber.

18 Claims, 2 Drawing Sheets

RESIDUAL PRESSURE DIFFERENTIAL REMOVAL MECHANISM FOR A SETTING DEVICE FOR A SUBTERRANEAN TOOL

FIELD OF THE INVENTION

The field of the invention is pressure operated setting modules for subterranean tools and more particularly where the tools are set with piston movement against a low pressure chamber and the low pressure chamber is brought to annulus pressure after piston stroking to set the tool.

BACKGROUND OF THE INVENTION

Many pressure set tools are offered that can be set with building tubing pressure against an obstruction such as a seated ball in the tubular string with a port to communicate to a setting piston to move tool components to the set position. In some cases the operator requires an ability to use the annulus hydrostatic pressure in conjunction with added annulus pressure to also set the tool. Either of these methods could be primary. In the instance where added pressure to the annulus is to be the trigger for setting the tool one way the setting has been accomplished is to isolate an external setting piston from well fluids on the way into the well. When the tool is properly positioned, pressure is built above the hydrostatic pressure at the setting depth. More recently setting depths have increased to 10,000 meters making the hydrostatic pressure alone very high. Raising the annulus pressure from the surface further increases the pressure at the setting tool so that a frangible member breaks to allow annulus pressure to one side of an operating piston. The other side of the piston is referenced to a sealed chamber with essentially atmospheric pressure. Pressure differential moves the piston to set the tool such as a packer by diminishing the volume of the atmospheric chamber. While the pressure in the atmospheric chamber rises somewhat from the volume reduction, the end pressure is still infinitesimal when compared to the hydrostatic pressure that continues to act on the other side of the piston even after the applied pressure that broke the frangible member is withdrawn. However, the subterranean tool and its setting module that includes the setting piston will need to stay downhole for the service life of the tool design. The piston continues to see a very large net force over the service life of the tool design. This ongoing large net force has to be accounted for in the component designs of the setting tool and the subterranean tool. The fact that such a high residual force remains causes compromises to be made in other design parameters that may be less than optimal. For example materials need to be selected that have a higher strength that may add cost over less expensive or weaker metals. The flow bore may need to be reduced to allow use of thicker parts to resist collapse force. Ideally if such design compromises could be avoided with a simple modification to the known designs then greater design independence can be accomplished that results in greater tool performance and optimized cost. In essence the present invention addresses this problem with a solution that communicates the atmospheric chamber to the surrounding annulus pressure to eliminate the large residual net force on the setting piston after the setting piston has stroked and set the tool. A preferred way this is done is to use two pressure levels with a first acting to set the tool by moving the piston and a second and higher level acting to communicate the atmospheric chamber with the surrounding wellbore annulus hydrostatic pressure. Other alternatives to accomplishing the reduction of pressure differential on the actuating piston after it strokes to set the tool are also envisioned. Those skilled in the art will understand further aspects of the invention from the description of the preferred embodiment below with the associated drawings while understanding that the full scope of the invention is to be determined from the appended claims.

SUMMARY OF THE INVENTION

A pressure actuated module associated with a subterranean tool is set with pressure in the well annulus supplemented by added pressure. The addition of pressure to the hydrostatic opens access to a setting piston that is referenced to a low pressure chamber. The piston strokes to a travel stop reducing the volume of the atmospheric chamber while setting the tool. After the tool is set the annulus is communicated to the low pressure reference chamber for the actuating piston to remove a residual net force on the setting piston after the set. One way to do this is to sequentially break multiple rupture discs at different pressures. Another is to have a degradable member in the atmospheric chamber. Another way is to use a piston device that is fixed in place during setting, and then with the application of additional pressure, will shift and allow pressure to pass through a port between the annulus and the atmospheric chamber, as shown in FIG. 4.

DETAILED DESCRIPTION OF THE PREFERRED EMBODIMENT

Figure 1:
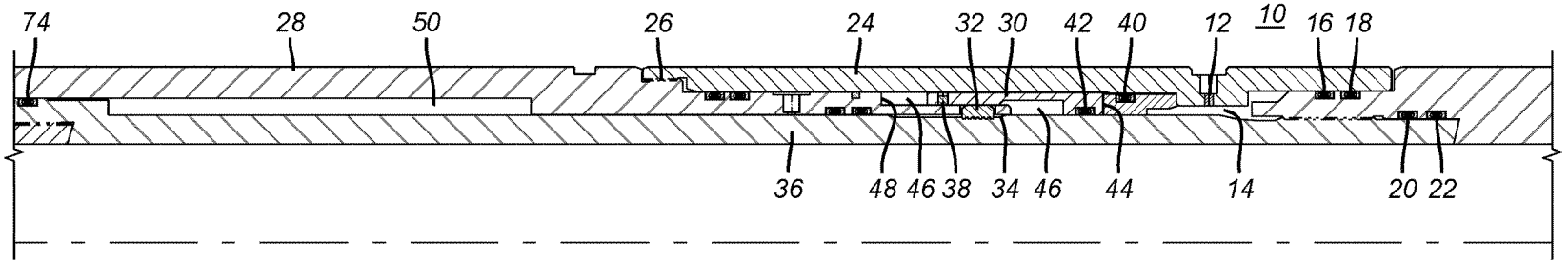
FIG. 1 is a section view of an actuation module for a subterranean tool that responds to wellbore annulus pressure increase to set the tool.

FIG. 1 illustrates the actuation assembly for a subterranean tool that is not shown. The tool can be a packer with slips and a sealing element, an anchor, a sliding sleeve or a variety of other tools. The tool can also optionally have a means of setting with internal tubing string pressure such as by seating a ball on a seat in the tubular string but that is also not shown as it is a setting mechanism that is well known in the art. What is shown is a setting mechanism that employs a combination of hydrostatic pressure in an annular space 10 that can be augmented with applied pressure from the surface, for example, to build the pressure next to rupture disc or other frangible or disintegrating or disappearing member 12 to gain access to chamber 14 that is run in at essentially atmospheric pressure. Chamber 14 is sealingly isolated on one side by seals 16, 18, 20 and 22. Seals 16 and 18 are opposite piston sleeve 24 that is attached at thread 26 to piston 28 whose movement shown in FIG. 3 actuates the subterranean tool that is not shown.

Figure 2:
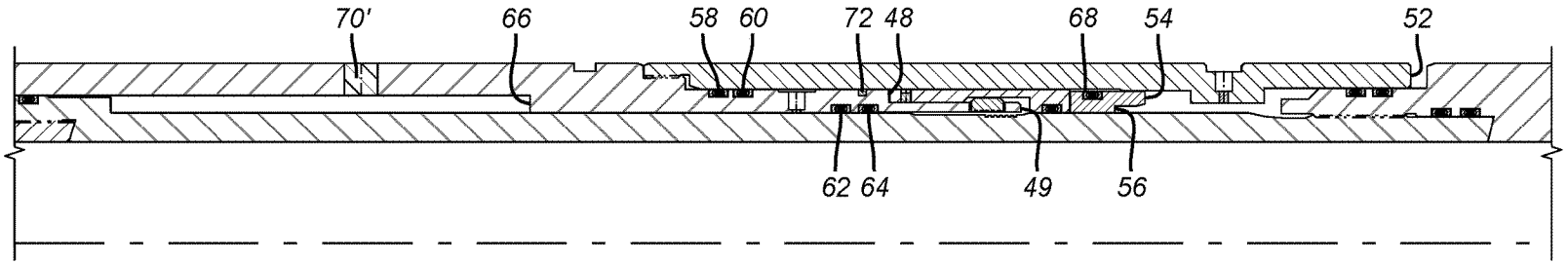
FIG. 2 is the view of FIG. 1 with the first rupture disc broken and the setting lock defeated with initial piston movement.
Figure 3:
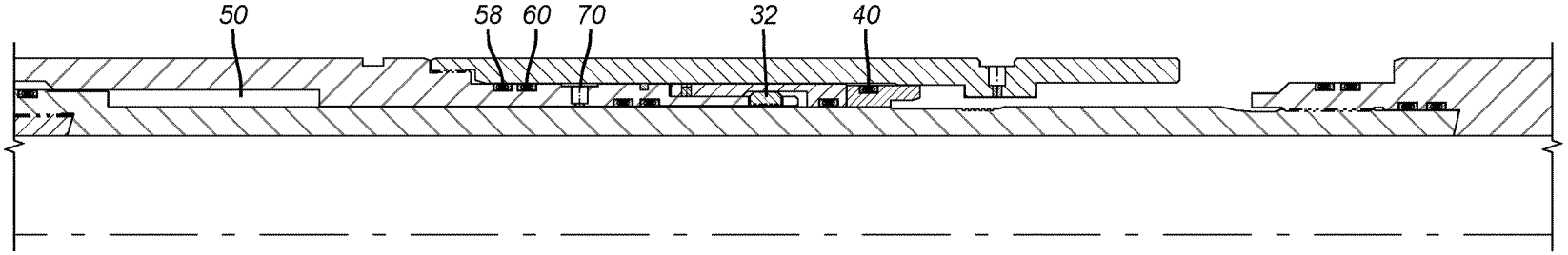
FIG. 3 is the view of FIG. 2 showing the piston stroked reducing the atmospheric chamber volume and a second rupture disk broken to equalize pressure of the atmospheric chamber with the surrounding annulus pressure.

A lock sleeve 30 is disposed within sleeve 24 to hold dogs or equivalent locking members 32 trapped in a recess 34 in mandrel 36. The piston 28 is thus held against movement for run in as shown in FIG. 1. A shear pin 38 can also be used to initially retain the lock sleeve 30 to the piston 28. Seals 40 and 42 also finish off the assembly of seals that allow pressure to build in chamber 14 when member 12 no longer holds back pressure in the surrounding annular space 10. Passage 44 prevents actuation of the subterranean tool in the even seals 16, 18, 20, or 22 leak during running in. If any of those seals leak flow may enter chamber 46 which is on an opposite side of lock sleeve 30 from chamber 14. If that happens then lock sleeve 30 has pressure equalized on opposite sides and cannot move. On the other hand, if none of the seals 16, 18, 20, or 22 leak, the admission of pressure into chamber 14 will force the lock sleeve 30 against shoulder 48 as shown in FIG. 2. When that happens the dogs 32 can exit groove 34 so that the piston 28 is no longer locked to the mandrel 36. At this point the low pressure reference chamber 50 comes into play. The movement of piston 28 is caused by the net force of pressure in the annular space 10 acting on one side of piston 28 that is far greater than the resisting force on piston 28 from the low pressure chamber 50. Specifically the pressure in the annular space 10 acts on surfaces 48, 49 and 52 when sleeve 30 is bottomed on surface 48 as shown in FIG. 2. Seals 58, 60, 62 and 64 isolate chambers 50 and 14 from each other. Because the pressure in chamber 50 is so much lower than in chamber 14 and the pressure in chamber 50 is pushing only against surface 66 the net result is movement of piston 28 to set the tool while reducing the volume and incidentally somewhat raising the pressure in chamber 50. The set position of the piston 28 is seen in FIG. 3. With the description offered thus far, there will be a lingering net force on the shifted piston 28 in the FIG. 3 set position due to the pressure difference in the annular space 10 and the low pressure chamber 50 in the FIG. 3 shifted position of the piston 28.

However, the present invention addresses reduction or elimination of the net force acting on the piston 28 in its shifted position of FIG. 3. One way this is done is to move seal 40 into an undercut in sleeve 24 so that pressure in the annular space 10 during the setting movement of piston 28 can reach seal 60 by bypassing seal 40. When this happens there is access to another member 70 that can provide pressure access to chamber 50 either immediately or at a later time. For example member 70 can be similar to member 12 but set to release at a higher pressure. In that case raising the pressure in annular space 10 to a first level will move the piston 28 to set the tool but will not cause member 70 to fail until the pressure in annular space 10 is raised again to a second and higher level than the setting pressure value. When that happens pressure that already has bypassed seal 40 due to undercut 68 and has been slowed in reaching seal 60 by a diffuser ring 72 will now break member 70 or otherwise get pressure past it and into chamber 50 to dramatically increase its pressure so that there will be little or likely no meaningful net force remaining on piston 28 after the tool is set and for the duration of the time that the tool is left in position in a borehole. This absence of a meaningful residual net force after setting in what had been the reference low pressure chamber 50 for the piston 28 will allow design advantages in material selection or thickness that can make a design less costly or provide an ability to have a larger flow passage for production or injection fluids or other advantages described above.

Alternative ways to reduce the net force acting on piston 28 after shifting are envisioned. Member 70 can be a dissolving, disintegrating or disappearing plug such that by virtue of exposure to well fluids for a time after the piston shifts results in opening a flow path from annular space 10 to the chamber 50. A controlled electrolytic material can form a plug to serve as member 70 to serve this purpose of net force reduction on the shifted piston 28.

Figure 4:
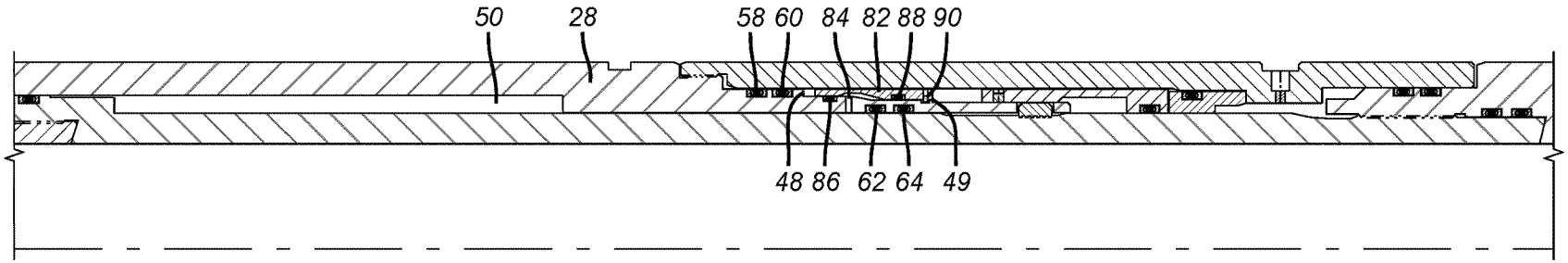
FIG. 4 is an alternative embodiment to FIG. 3.

FIG. 4 shows a small piston 82 in between location 48 and seal 60. Length is added to piston 28 and item 24, such that the small piston 82 would be covering a port 84, in place of member 70, which gave access to chamber 50. The piston 82 is shear pinned 90 or otherwise affixed to item 28. Movement of the piston 82 would take place in FIG. 4, after item 30 had shifted, the tool was set, and additional pressure was added to the annulus. The pressure will act across seals 86 and 88, shift the piston 82 and allow annulus communication with the chamber 50. In this way, the method of letting annular pressure into chamber 50, by going to a second and higher pressure added to the annulus pressure, is similar to the other described embodiments.

Alternatively, member 70 can be placed in location 70' for simpler access when redressing the tool during assembly, after assembly is complete, or time in storage since the location in the piston 28 is externally exposed. In addition location 70' allows for high flow circulation in order to dissolve CEM material. Many current designs feature a threaded or otherwise secured plug already in piston 28 so that it would be a simple matter with no re-engineering to simply place member 70' in the same threads now occupied by the threaded plug. This plug is now used for pressure testing of the assembly process before use. It should be noted that member 12 while intact isolates the chamber 14 and the components that define it from pressure in the annular space 10. Passage 44 serves as a fail-safe feature in the event of leakage of seals 16, 18, 20 or 22 that lets pressure into chamber 14 during running in. If that happens the lock sleeve 30 is prevented from shifting so that piston 28 remains immobile. The known designs leave chamber 50 with whatever residual pressure that it has after setting. In applications of fairly low depth the hydrostatic pressure is low enough to not make much difference in the selection of components for the design. However, when the depths go to 10,000 meters or more the hydrostatic pressure in the annular space can be so high that the equipment design is affected. The present invention takes the annular space pressure out of the equation for deployments at any depth.

One advantage of the present invention is the ability to use a two-step "set and release" process that allows for full setting force and then removal of the setting force at any time after setting, in one case by application of additional pressure to a rupture disc.

The above description is illustrative of the preferred embodiment and many modifications may be made by those skilled in the art without departing from the invention whose scope is to be determined from the literal and equivalent scope of the claims below:

We claim:

1. A setting mechanism for a subterranean tool, comprising:

a selectively movable piston mounted to a mandrel so that movement of said piston sets the subterranean tool;

said piston is selectively exposed to pressure on a first side and is referenced to an opposing pressure in a reference chamber such that said selective exposure creates a force imbalance on said piston to urge said piston to move to reduce the volume of said reference chamber while setting the subterranean tool;

said reference chamber pressure in said reduced volume configuration further rises after sufficient movement of said piston that sets the subterranean tool, whereupon with said tool set further movement of said piston opens access to said reference chamber for said further raising of pressure therein.

2. The mechanism of claim 1, wherein:

said reference chamber pressure is raised to equal pressure selectively exposed to said first side of said piston.

3. The mechanism of claim 1, wherein:

said reference pressure rises only after said movement of said piston.

4. The mechanism of claim 1, wherein:

said selective exposure on said first side of said piston occurs with surrounding annular space pressure at a predetermined first value and said rise of said reference chamber pressure occurs on elevation of surrounding annular space pressure to a second value higher than said first value.

5. The mechanism of claim 4, wherein:

a first rupture disc in communication with said first side of said piston is broken with said pressure at said first value and a second rupture disc in communication with said reference chamber is broken with pressure at said second predetermined value.

6. The mechanism of claim 1, wherein:

said reference chamber pressure rise occurs with undermining a seal in communication with said reference chamber responsive to movement of said piston to set the subterranean tool.

7. The mechanism of claim 1, wherein:

said reference chamber pressure rise occurs with selective communication of said reference chamber to higher pressure.

8. The mechanism of claim 7, wherein:

said higher pressure is located in a surrounding annular space to said mandrel.

9. The mechanism of claim 8, wherein:

said selective communication occurs with undermining a barrier between said reference chamber and said surrounding annular space.

10. The mechanism of claim 9, wherein:

said barrier undermining begins only after movement of said piston sets the subterranean tool.

11. The mechanism of claim 10, wherein:

said barrier undermining begins with exposure to fluid from the surrounding annular space made possible by movement of said piston.

12. The mechanism of claim 11, wherein: said barrier undermining occurs from pressure of fluid from said surrounding annular space; and said barrier undermining occurs from dissolving, disintegrating or otherwise failing said barrier as a result of exposure to fluid from said surrounding annular space.

13. The mechanism of claim 12, wherein: said barrier is made from a controlled electrolytic material.

14. The mechanism of claim 10, wherein:

a diffuser in the path of pressure between an undermined seal and said barrier.

15. The mechanism of claim 10, wherein:

said pressure access to said first side occurs with breaking a rupture disc;

said piston is precluded from moving by being in pressure balance if at least one of said seals leaks before breaking said rupture disc.

16. The mechanism of claim 9, wherein:

said barrier is located directly on said reference chamber for external access for replacement or within said piston and in fluid communication with said reference chamber.

17. A setting mechanism for a subterranean tool, comprising:

a selectively movable piston mounted to a mandrel so that movement of said piston sets the subterranean tool;

said piston is selectively exposed to pressure on a first side and is referenced to an opposing pressure in a reference chamber such that said selective exposure creates a force imbalance on said piston to urge said piston to move to reduce the volume of said reference chamber while setting the subterranean tool;

said reference chamber pressure in said reduced volume configuration further rises after movement of said piston that sets the subterranean tool;

said reference chamber pressure rise occurs with selective communication of said reference chamber to higher pressure;

said higher pressure is located in a surrounding annular space to said mandrel;

said selective communication occurs with undermining a barrier between said reference chamber and said surrounding annular space;

said barrier undermining begins only after movement of said piston sets the subterranean tool;

a diffuser in the path of pressure between an undermined seal and said barrier;

said pressure access to said first side occurs with breaking a rupture disc;

said piston is locked to said mandrel until the said rupture disc breaking initially moves a lock sleeve to unsupport dogs extending through said piston and into a mandrel recess.

18. A setting mechanism for a subterranean tool, comprising:

a selectively movable piston mounted to a mandrel so that movement of said piston sets the subterranean tool;

said piston is selectively exposed to pressure on a first side and is referenced to an opposing pressure in a reference chamber such that said selective exposure creates a force imbalance on said piston to urge said piston to move to set the subterranean tool;

said reference chamber pressure rises after movement of said piston;

said pressure access to said first side occurs with breaking a rupture disc;

said piston is locked to said mandrel until the said rupture disc breaking initially moves a lock sleeve to unsupport dogs extending through said piston and into a mandrel recess;

said lock sleeve comprises a passage extending transversely therethrough between two said seals such that leakage of another of said seals before said rupture disc is broken puts said lock sleeve in pressure balance such that said piston cannot move relative to said mandrel.

* * * * *